US009189989B2

(12) United States Patent
Maeda et al.

(10) Patent No.: US 9,189,989 B2
(45) Date of Patent: Nov. 17, 2015

(54) INTEGRATED CIRCUIT FOR USE IN PLASMA DISPLAY PANEL, ACCESS CONTROL METHOD, AND PLASMA DISPLAY SYSTEM

(75) Inventors: Masaki Maeda, Osaka (JP); Naoki Ootani, Osaka (JP); Tokuzo Kiyohara, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 158 days.

(21) Appl. No.: 13/393,349

(22) PCT Filed: Jun. 9, 2011

(86) PCT No.: PCT/JP2011/003281
§ 371 (c)(1),
(2), (4) Date: Feb. 29, 2012

(87) PCT Pub. No.: WO2012/001886
PCT Pub. Date: Jan. 5, 2012

(65) Prior Publication Data

US 2012/0154414 A1 Jun. 21, 2012

(30) Foreign Application Priority Data

Jun. 28, 2010 (JP) ..... 2010-146466

(51) Int. Cl.
*G09G 3/28* (2013.01)
*G09G 3/288* (2013.01)
(Continued)

(52) U.S. Cl.
CPC ..... *G09G 3/288* (2013.01); *G09G 3/293* (2013.01); *G09G 3/2022* (2013.01); *G09G 5/395* (2013.01); *G09G 2320/103* (2013.01)

(58) Field of Classification Search
CPC ..... G06F 12/00; G06F 13/18; G06F 13/1663
USPC ..... 345/60, 519, 535, 541–42, 555; 375/240, 240.01
See application file for complete search history.

(56) References Cited

U.S. PATENT DOCUMENTS 6,678,331 B1 * 1/2004 Moutin et al. ..... 375/240.25
7,598,931 B2 * 10/2009 Han ..... 345/60
(Continued)

FOREIGN PATENT DOCUMENTS

CN 1755771 A 4/2006
CN 1806271 A 7/2006
(Continued)

OTHER PUBLICATIONS

International Search Report issued Sep. 13, 2011 in International (PCT) Application No. PCT/JP2011/003281.
(Continued)

*Primary Examiner* — Waseem Moorad
*Assistant Examiner* — Mark Edwards
(74) *Attorney, Agent, or Firm* — Wenderoth, Lind & Ponack, L.L.P.

(57) ABSTRACT

A plasma display system restricts peak data traffic when a shared memory is used. In the plasma display system, a control unit prohibits a moving picture decoder from accessing a shared memory while an SF reading unit is reading, from the shared memory, SF pixel data which is information about respective cells to be lit in a plurality of subfields. On the other hand, the control unit permits the moving picture decoder to access the shared memory while the SF reading unit is not reading the SF pixel data from the shared memory during a sustain discharge period.

8 Claims, 11 Drawing Sheets

(51) Int. Cl.

| | |
|---|---|
| ***G09G 3/293*** | (2013.01) |
| *G09G 3/20* | (2006.01) |
| *G09G 5/395* | (2006.01) |

(56) References Cited

U.S. PATENT DOCUMENTS

| | | | | |
|---|---|---|---|---|
| 2003/0103059 | A1* | 6/2003 | Correa et al. | 345/596 |
| 2004/0095356 | A1* | 5/2004 | Inoue et al. | 345/531 |
| 2006/0165278 | A1* | 7/2006 | Uryu et al. | 382/162 |
| 2007/0057960 | A1 | 3/2007 | Itoh et al. | |
| 2007/0205969 | A1* | 9/2007 | Hagood et al. | 345/84 |
| 2008/0165287 | A1* | 7/2008 | Doswald et al. | 348/718 |
| 2008/0192061 | A1 | 8/2008 | Lim | |
| 2009/0297051 | A1 | 12/2009 | Nonaka et al. | |

FOREIGN PATENT DOCUMENTS

| | | | |
|---|---|---|---|
| CN | 101554053 | A | 10/2009 |
| CN | 101594535 | A | 12/2009 |
| JP | 9-16142 | | 1/1997 |
| JP | 11-175024 | | 7/1999 |
| JP | 2003-528517 | | 9/2003 |
| JP | 3532796 | | 3/2004 |
| JP | 2004-309846 | | 11/2004 |
| JP | 2005-17725 | | 1/2005 |
| JP | 2005-338123 | | 12/2005 |
| JP | 2007-79292 | | 3/2007 |
| JP | 2008-197653 | | 8/2008 |

OTHER PUBLICATIONS

"Information technology—Generic coding of moving pictures and associated audio information: Video" ISO/IEC 13818-2, International Standard, MPEG-2 Video, Second edition, Dec. 15, 2000.

"Information technology—Coding of audio-visual objects—Part 10: Advanced video coding", ISO/IEC 14496-10, International Standard, First edition, Dec. 1, 2003.

Tsutae Shinoda, "Purazuma disupurei zairyo gijyutsu no saizensen (Advanced Technology of PDP Composition Material)", CMC publishing Co., Ltd., Oct. 2007, pp. 41-44 along with partial English translation.

Chinese Office Action issued Sep. 3, 2014 in Chinese Application No. 201180003636.6 (with partial English translation).

* cited by examiner

FIG. 2

111

| Subfield number (201) | SF pixel data transfer period (address period) [msec] (202) | Sustain discharge period [msec] (203) |
|---|---|---|
| SF1 | 0.78 | 0.28 |
| SF2 | 0.78 | 0.56 |
| SF3 | 0.78 | 0.84 |
| SF4 | 0.78 | 1.12 |
| SF5 | 0.78 | 1.40 |
| SF6 | 0.78 | 1.68 |
| SF7 | 0.78 | 1.96 |
| SF8 | 0.78 | 2.24 |

FIG. 6

112

601 602 603

| Subfield number | SP pixel data transfer period (address period) [msec] | Sustain discharge period [msec] |
|---|---|---|
| SF1 | 0.78 | 0.16 |
| SF2 | 0.78 | 0.32 |
| SF3 | 0.78 | 0.48 |
| SF4 | 0.78 | 0.64 |
| SF5 | 0.78 | 0.80 |
| SF6 | 0.78 | 0.96 |
| SF7 | 0.78 | 1.12 |
| SF8 | 0.78 | 1.28 |
| SF9 | 0.78 | 1.44 |
| SF10 | 0.78 | 1.60 |

FIG. 9

900

901 902

| Pattern number | Pattern data content |
|---|---|
| 001 | 00000000 |
| 002 | 11111111 |
| 003 | 01010101 |
| ⋮ | ⋮ |

INTEGRATED CIRCUIT FOR USE IN PLASMA DISPLAY PANEL, ACCESS CONTROL METHOD, AND PLASMA DISPLAY SYSTEM

BACKGROUND OF INVENTION

1. Technical Field

The present invention relates to technologies for restricting peak data traffic during memory accesses required for generating and acquiring data for controlling light emission of a plasma display panel.

2. Background Art

Conventionally, when moving pictures are transferred or recorded onto a recording medium, compression technologies according to the MPEG (Moving Picture Experts Group) standards, such as the MPEG2 video standards described in Non-Patent Literature 1 below and the MPEG4AVC (Advanced Video Coding) standards described in Non-Patent Literature 2, are used. Likewise, moving picture decoders for decoding the images that have been compressed according to the standards are known.

Such a moving picture decoder decodes a variable-length coded stream of compressed images stored in a memory such as a large-capacity DRAM (Dynamic Random Access Memory) by the following procedure. Firstly, the moving picture decoder reads the stream from the memory, and decodes the read stream to extract motion vectors as well as block data on a block-by-block basis. Secondly, the moving picture decoder refers to a reference image in the memory as specified by the motion vectors, and performs compensation processing which is a kind of a reverse of motion estimation processing. Finally, the moving picture decoder stores, in the memory, decoded images obtained from the compensation processing. A series of decoded images, decoded and stored in the memory in this way, are used as a series of reference images for decoding of subsequent compressed images and/or as a series of images to be displayed on a display screen.

However, as commonly known, the above decoding processing of moving pictures requires a large amount of data traffic for memory accesses. In such a system including a moving picture decoder and an image display, various methods, including a method of restricting peak data traffic in the entire processing and a method of using a memory system having a large data traffic capacity, are employed in order to restrict a significant increase in data traffic. Among the methods, the method of restricting the peak data traffic in the entire processing is disclosed in Patent Literature 1.

Patent Literature 1 describes a device including an audio decoder, a moving picture decoder, and an image display. The device restricts the peak data traffic, by causing the audio decoder to process a large amount of data traffic during a blanking period of the moving picture decoder and causing the audio decoder to process a small amount of data traffic during a data transfer period of the moving picture decoder (see FIG. 11). Note that in FIG. 11 an area shaded by horizontal lines represent data transfers by the moving picture decoder, and areas shaded by oblique lines represent data transfers by the audio decoder.

CITATION LIST

Patent Literature

[Patent Literature 1] Japanese patent No. 3532796

Non-Patent Literature

[Non-Patent Literature 1] ISO/IEC 13818-2 International Standard MPEG-2 Video

[Non-Patent Literature 2] ISO/IEC 14496-10 International Standard Information technology—Coding of Audio-Visual Objects-Part 10: Advanced Video Coding

[Non-Patent Literature 3] "Advanced Technology of PDP Composition Material", supervised by Tsutae Shinoda (CMC publishing, Oct. 31, 2007), pp. 41-44.

SUMMARY OF INVENTION

In plasma display panels, it can be considered to mount, on a single chip, all of: a moving picture decoder; a converter that executes subfield conversion, which is a control specific to plasma displays; and a reader that reads subfield data after conversion from the memory for output.

However, when the image display is an ADS (Address Display Separated)-type plasma display processing unit (as in Non-Patent Literature 3), since respective data transfer peaks of the moving picture decoder, the converter, and the reader differ from each other, a problem arises that the peak data traffic in the processing of the moving picture decoder and the reading unit cannot be restricted according to the method of Patent Literature 1.

The present invention has been conceived in view of the above problem and aims to provide a system and a method for restricting the peak data traffic when the moving picture decoder and the reading unit are combined into a single chip, and when the memory is shared.

In order to solve the above problem, one aspect of the present invention provides an integrated circuit for use in a plasma display panel, comprising: a decoder that reads encoded moving picture data from a shared memory, decodes the encoded moving picture data to obtain decoded data, and stores the decoded data in the shared memory, wherein the shared memory is shared by the decoder, a converter, a reading unit, and an access control unit; the converter that reads the decoded data from the shared memory, converts the decoded data into subfield data, and stores the subfield data in the shared memory; the reading unit that reads the subfield data from the shared memory; and the access control unit that restricts an access from the decoder to the shared memory while the reading unit is reading the subfield data from the shared memory.

With the above structure, while the reading unit is reading the data, the moving picture decoder is prevented from accessing the shared memory. As a result, the peak data traffic is restricted.

BRIEF DESCRIPTION OF DRAWINGS

FIG. 2 is a data conceptual diagram showing an example of a structure of a control table for 8 subfields.

FIG. 6 is a data conceptual diagram showing another example of the structure of the control table for 10 subfields.

FIG. 9 shows a pattern data according to Embodiment 3.

DETAILED DESCRIPTION OF INVENTION

The following describes a plasma display system including an integrated circuit for use in a plasma display, which is a preferred embodiment of the present invention, with reference to the drawings.

<Embodiment 1>

<Structure>

Figure 1:
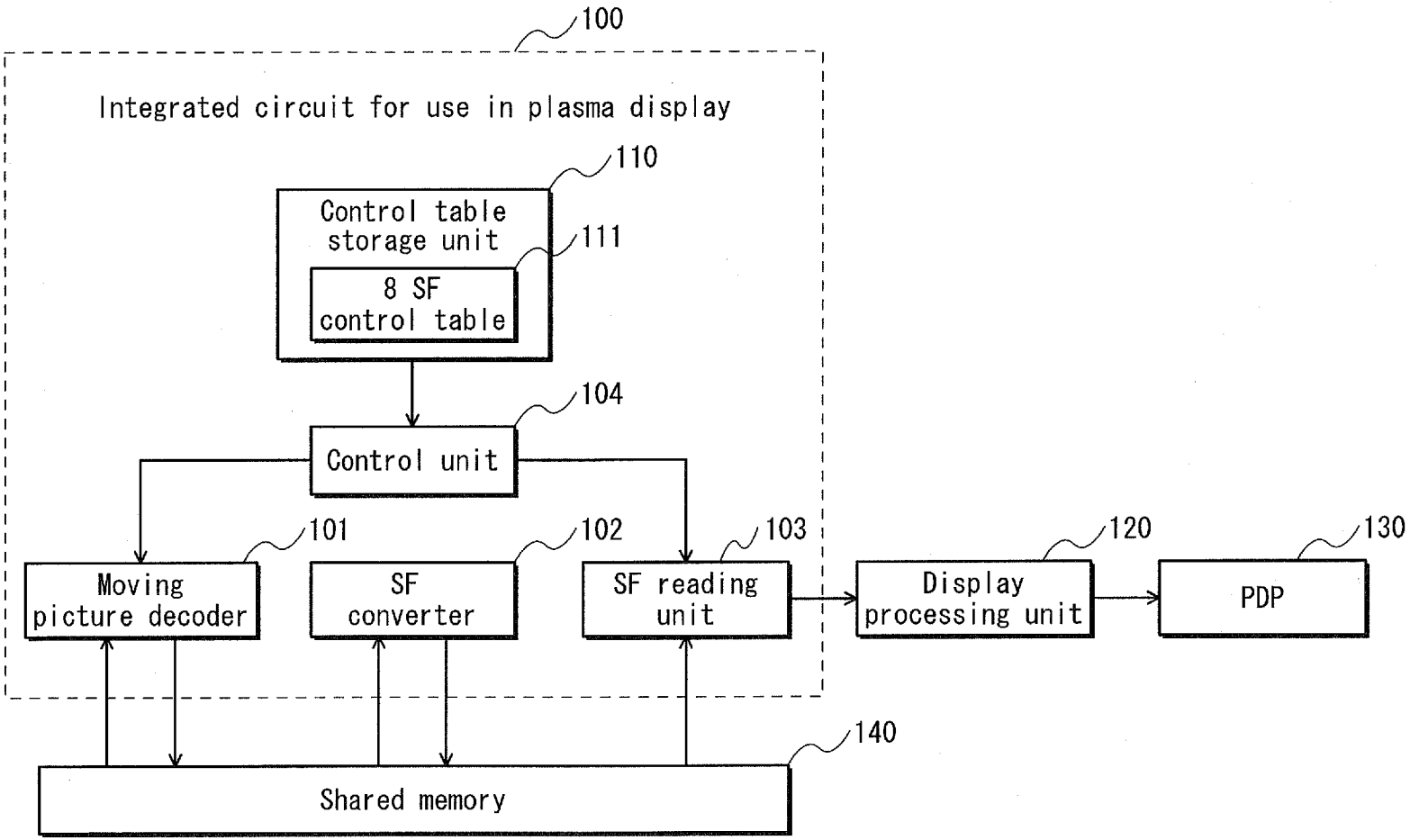
FIG. 1 is a functional block diagram showing a functional structure of a plasma display system according to Embodiment 1.

FIG. 1 is a functional block diagram showing a functional structure of the plasma display system.

The plasma display system includes an integrated circuit 100 for use in a plasma display (abbreviated below as the "integrated circuit 100"), a display processing unit 120, a PDP 130, and a shared memory 140.

The integrated circuit 100 is a semiconductor integrated circuit, so-called LSI (Large Scale Integration). The integrated circuit 100 has a function of generating, for each pixel, data regarding light-on/light-off (referred to below as "SF pixel data") in 8 subfields (abbreviated below as "SFs"), from a bit stream that has been compressed according to the MPEG4AVC standards and stored in the shared memory 140. The integrated circuit 100 also has a function of transmitting the SF pixel data to the display processing unit 120 in accordance with timings of address periods in the ADS driving method.

The integrated circuit 100 includes a moving picture decoder 101, an SF converter 102, an SF reading unit 103, and a control unit 104.

The moving picture decoder 101 has: a function of sequentially reading, from the shared memory 140, bit streams (i.e. moving picture data) compressed according to the MPEG4AVC standards, as well as reference images; a function of decoding the images according to the MPEG4AVC standards; and a function of storing decoded images (i.e. decoded data) obtained by the decoding into the shared memory 140.

The SF converter 102 has: a function of reading the decoded images from the shared memory 140 that the moving picture decoder 101 has stored after the decoding; a function of converting the decoded images into SF pixel data; and a function of storing the SF pixel data obtained by the conversion into the shared memory 140. The conversion into the SF pixel data is conventionally performed, and a description is given of one example thereof.

When reading the decoded images from the shared memory 140, the SF converter 102 reads data of the decoded images, and each data corresponding to one pixel is 8-bit data (which can indicate numbers that each represent one of 256 possible gradations).

Based on the number indicated by the 8-bit data, the SF converter 102 determines subfields in which a cell corresponding to a pixel is to be illuminated. Specifically, the SF converter 102 converts, in units of data worth of one TV field, the pixels into pieces of information (i.e. data) that each indicate light-on and light-off states in the respective subfields belonging to the one TV field. For example, assume a case where 8-bit data corresponding to a pixel (which corresponds to either red, blue, or green) is converted into a piece of subfield data, where the 8-bit data is represented by "01001010". In this case, (SF1XY, SF2XY, SF3XY, SF4XY, SF5XY, SF6XY, SF7XY, SF8XY)=(0, 1, 0, 1, 0, 0, 1, 0). In other words, regarding the 8-bit data corresponding to the pixel located at a coordinate (X, Y) in the original decoded image, a value of the 0-th bit is converted into a piece of SF pixel data of a subfield 1, a value of the 1st bit is converted into a piece of the SF pixel data of a subfield 2, a value of the 2nd bit is converted into a piece of the SF pixel data of a subfield 3, . . . a value of the 7-th bit is converted into a piece of the SF pixel data of a subfield 8. Note that SFNXY represents a piece of the SF pixel data of an N-th subfield regarding the cell represented by the coordinate (X, Y). Each piece of the SF pixel data is 1-bit long, and "1" represents the light-on state and "0" represents the light-off state.

The SF reading unit 103 has a function of accessing, according to an instruction from the control unit 104, the shared memory 140 to read the pieces of the SF pixel data stored by the SF converter, and a function of outputting the read pieces of the SF pixel data to the display processing unit 130.

The control unit 104 has a function of performing control over the accesses from the moving picture decoder 101 and the SF reading unit 103 to the shared memory.

The display processing unit 120 drives the PDP 130 by the ADS driving method. The display processing unit 120 has a function of discharging all the cells of the PDP 130 in a reset period to form uniform wall charges.

The display processing unit 120 causes the lighting cells of the PDP 130 to accumulate the wall charges in an address period. The light-on and the light-off state of the cells is determined by the SF pixel data sent from the display processing unit 120. If a piece of the SF pixel data corresponding to one cell indicate the value 0, the cell is to be in the light-off state, and if the piece of the SF pixel data corresponding to the cell indicate the value 1, the cell is to be in the light-on state.

The display processing unit 120 causes discharge only in the cells of the PDP 130 in the light-on state during a sustain discharge period. Suppose that, in a case of 8 SFs, a discharge count in SF1 is $\alpha$ (where $\alpha$ is a positive integer 1 or greater), a discharge count in SF2 is $\alpha\times2$, a discharge count in SF3 is $\alpha\times2\hat{}2$, . . . a discharge count in SF8 is $\alpha\times2\hat{}7$. That is to say, a discharge count in SF N (where N=a SF number ranging from 1 to 8) is $\alpha\times2\hat{}(N-1)$. Note that "^" is a power operator, and $2\hat{}(N-1)$ (where N is a positive integer 1 or greater) denotes (N−1)th power of 2.

With the above control, a discharge count of each cell of the PDP 130 is controlled to be one of a total of $2\hat{}8$ (=256) patterns. Thus, by executing the light-on and the light-off states in the SFs included in each TV field with respect to each pixel, representation with the 256 gradations is realized.

The PDP 130 has a function of displaying an image by discharging the cells in response to an instruction from the display processing unit 120.

The shared memory 140 is a RAM (Random Access Memory) storing various data required for operations of the integrated circuit 100. The shared memory 140 stores therein the bit streams compressed according to the MPEG4AVC standards, the decoded images decoded by the moving picture decoder 101, and the pieces of SF pixel data obtained by converting the decoded images.

<Data>

Now, a description is given of a control table 111 for 8 SFs (referred to below as the "8 SF control table 111") stored in a control table storage unit 110. The control table includes a subfield number column 201, an SF pixel data transfer period (address period) column 202, and a sustain discharge period column 203, so that a subfield number, an SF pixel data transfer period (address period), and a sustain discharge period are indicated and are associated with each other. The control table herein is the information in a case of a total number of subfields being 8.

The subfield number column 201 indicates respective numbers by which the subfields are identified.

The SF pixel data transfer period column 202 indicates a time period required for the SF reading unit 103 to read pieces of SF pixel data from the shared memory 140 and determine which cells to be illuminated. The determination is performed by scanning all the cells on the screen, and the SF pixel data transfer period (address period) is 0.78 msec in any of the subfields.

The sustain discharge period column 203 indicates respective time periods for which discharge is to be maintained in pixels in the associated subfields. For example, the sustain discharge period associated with the subfield number 4 (SF4) is 1.12 msec.

With use of the 8 SF control table 111, the control unit 104 controls memory accesses from the moving picture decoder 101 and the SF reading unit 103 to the shared memory 140.

<Operations>

Figure 3:
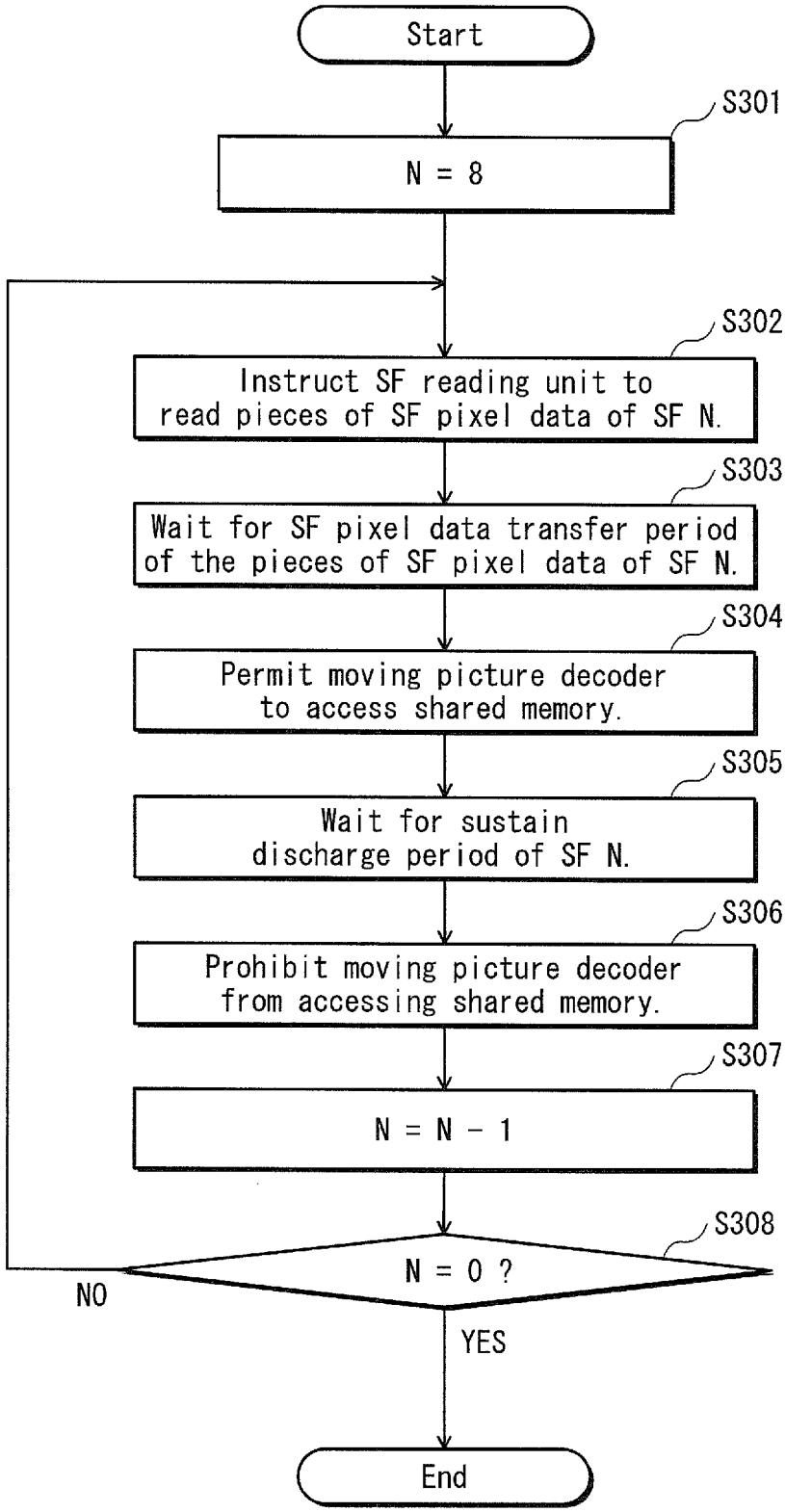
FIG. 3 is a flowchart showing operations involved in accessing a shared memory.

Next, a description is given of operations of the integrated circuit 100 according to the present Embodiment, with reference to a flowchart shown in FIG. 3.

FIG. 3 shows operations involving control over accesses to the shared memory as performed by the control unit 104 in one TV field. Note that at the beginning of the operation procedure, the moving picture decoder 101 is prohibited from accessing the shared memory 140.

Firstly, the control unit 104 sets a variable N to be 8 (step S301). The variable N also indicates the total number of subfields.

The control unit 104 refers to the 8 SF control table 111, and reads a time period in the SF pixel data transfer period column 202 and a time period in the sustain discharge period column 203 both of which correspond to the subfield number in the subfield number column 201 identified by the value of the variable N.

The control unit 104 instructs the SF reading unit 103 to read pieces of SF pixel data of a SF N (step S302).

The control unit 104 waits for the read SF pixel data transfer period associated with the read pieces of SF pixel data (step S303).

Next, after the SF pixel data transfer period for the pieces of SF pixel data has passed, the control unit 104 permits the moving picture decoder 101 to access the shared memory 140 (step S304). Note that here a decoded image that is to be decoded by the moving picture decoder 101 is the image of a subsequent frame to the frame of the pieces of SF pixel data that the SF reading unit 103 is reading.

Then, the control unit 104 waits for the time period that has been read as the sustain discharge period (step S305).

After waiting for the sustain discharge period, the control unit 104 prohibits the moving picture decoder 101 from accessing the shared memory 140 (step S306).

The control unit 104 decrements the variable N by one (step S307), and determines whether or not N after decrement is 0 (step S308).

When N is not 0 (NO in the step S308), the processing returns to the step S302. On the other hand, when N is 0 (YES in the step S308), this means that the processing has been completed for all the subfields, and therefore the processing for the subfields included in the one TV field ends.

The control shown in FIG. 3 is repeatedly performed during playback control, whereby display processing of moving pictures etc. is performed.

Figure 4:
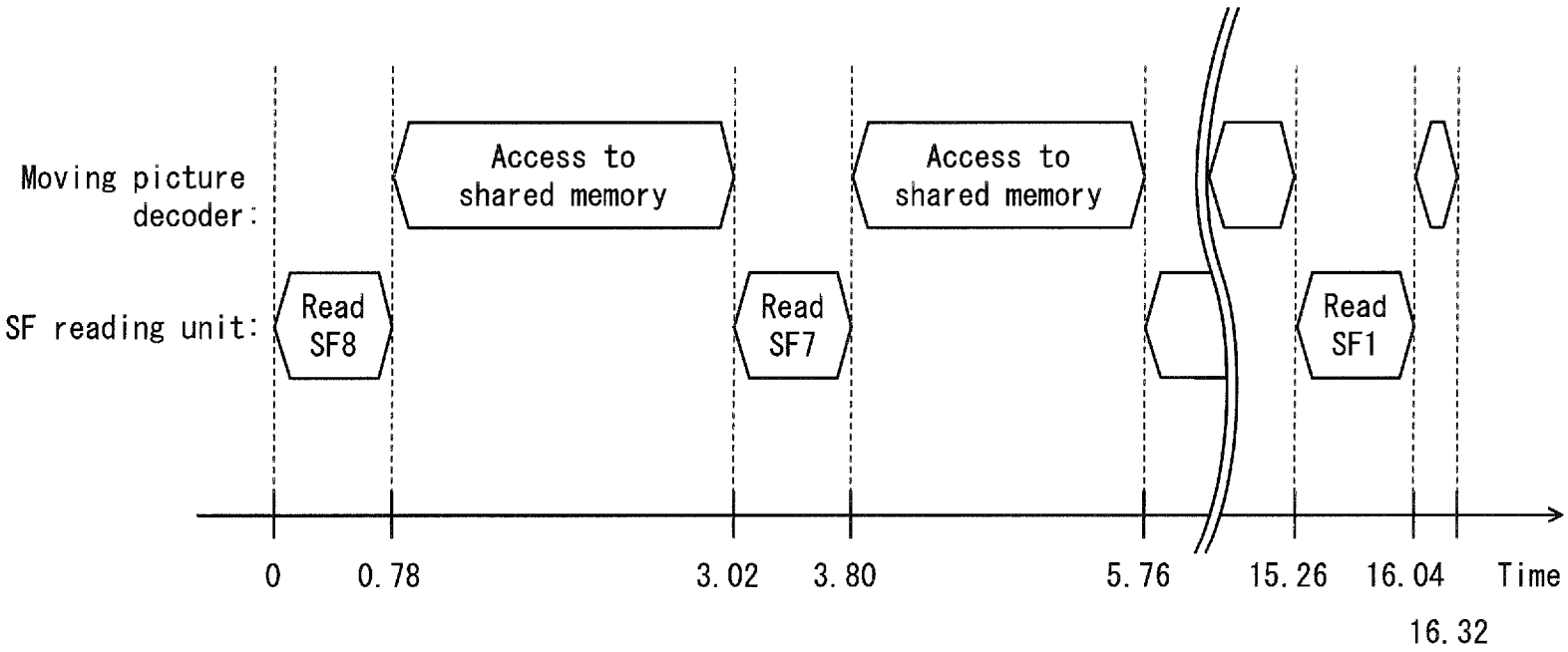
FIG. 4 shows how a moving picture decoder and an SF reading unit access the shared memory.

FIG. 4 shows an image of accesses from the moving picture decoder 101 and the SF reading unit 103 to the shared memory under the above control. In FIG. 4, a horizontal axis represents time.

As can be seen from FIG. 4, under the control of the control unit 104, during a time period from 0 msec to 0.78 msec, the SF reading unit 103 accesses the shared memory 140 to read pieces of SF pixel data for SF8 (which is an 8-th subfield), and transmits the read pieces of SF pixel data to the display processing unit 120. During the time period from 0 msec to 0.78 msec, the moving picture decoder 101 does not access the shared memory 140.

During a time period from 0.78 msec to 3.02 msec, the moving picture decoder 101 accesses the shared memory 140 to read the stored bit stream and the stored reference image, and stores decoded images. Since the time period from 0.78 msec to 3.02 msec is the sustain discharge period, the SF reading unit 103 does not access the shared memory 140.

During a time period from 3.02 msec to 3.80 msec, the SF reading unit 103 accesses the shared memory 140 again to read pieces of SF pixel for SF7, and transmits the read pieces of SF pixel data to the display processing unit 120. During the time period from 3.02 msec to 3.80 msec, the moving picture decoder 101 does not access the shared memory 140.

During a time period from 3.80 msec to 5.76 msec, the moving picture decoder 101 accesses the shared memory 140 to read the stored bit stream and the stored reference image, and stores decoded images. Since the time period from 3.80 msec to 5.76 msec is the sustain discharge period, the SF reading unit 103 does not access the shared memory 140.

Subsequently, the above processes are repeated until the moving picture decoder 101 accesses the shared memory 140 to read the stored bit stream and the reference image and stores the decoded image in a time period from 16.04 msec to 16.32 msec. Thus, the access control for the one TV field is completed.

The above processes prevents the increase in the peak data traffic due to simultaneous accesses from the moving picture decoder 101 and the SF reading unit 103 to the shared memory. Since the pieces of SF pixel data read by the SF reading unit 103 are used for specifying cells to be illuminated, no pieces of SF pixel data need to be read during the sustain discharge periods. Accordingly, during the sustain discharge periods, the SF reading unit 103 does not need to access the shared memory 140. Thus, the moving picture decoder 101 is allowed to access the shared memory 140 during the sustain discharge periods. Furthermore, while the SF reading unit 103 is reading the pieces of SF pixel data for specifying addresses, the moving picture decoder 101 is prohibited from accessing the shared memory 140. In other words, simultaneous accesses from the moving picture decoder 101 and the SF reading unit 103 to the shared memory 140 are prevented, whereby the peak data traffic is restricted.

<Embodiment 2>

The Embodiment 1 describes the example with the total number of subfields being 8. However, due to recent demands for high picture quality of images, some plasma displays sets the total number of subfields to be 10 for representation with 1024 gradations since the 256 gradations are not enough for the representation.

In view of the above, in Embodiment 2 a description is given of operations of the integrated circuit (for use in a plasma display) which selectively operates in the mode where the total number of subfields is 10 and in the mode where the total number of subfields is 8.

Note that the Embodiment 2 only describes structures that are different from those in Embodiment 1, and a description of common structures is omitted here.

<Structures>

Figure 5:
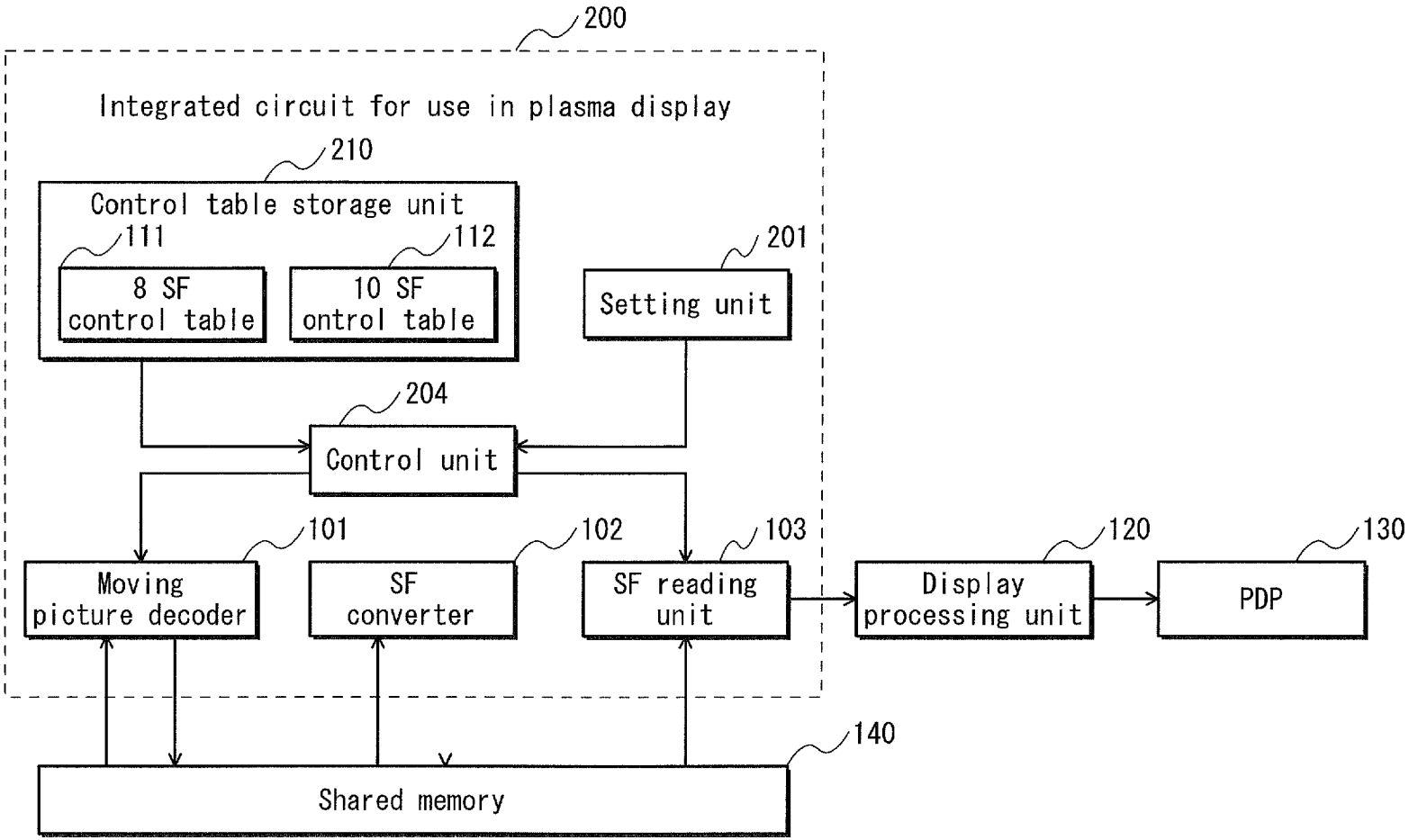
FIG. 5 is a functional block diagram showing another functional structure of the plasma display system according to Embodiment 2.

FIG. 5 is a functional block diagram showing a functional structure of the plasma display system including an integrated circuit 200 for use in a plasma display (abbreviated below as the "integrated circuit 200") according to the Embodiment 2. The integrated circuit 200 differs from the integrated circuit 100 as described in the Embodiment 1 in that it includes a control unit 204 instead of the control unit 104, a control table storage unit 210 instead of the control table storage unit 110, and a setting unit 201.

The setting unit 201 has a function of holding setting information indicating which one of 8 subfields per TV field and 10 subfields per TV field is to be used as the subfields in image display.

The control table storage unit 210 stores the 8 SF control table 111, as well as a 10 SF control table 112 which is a control table for 10 subfields. The 8 SF control table 111 is the same as that described in the Embodiment 1. The details of the 10 SF control table 112 are described later below.

The control unit 204 has, in addition to the function of the control unit 104 described in the Embodiment 1, a function of reading a control table depending on which one of 8 and 10 the total number of subfields is set in the setting unit 201, and a function of controlling accesses from the moving picture decoder 101 and the SF reading unit 103 to the shared memory 140 according to the read control table.

<Data>

The control table storage unit 210 stores, in addition to the control table for 8 SFs described in the Embodiment 1, the control table for 10 SFs.

As shown in FIG. 6, just like the 8 SF control table 111, the 10 SF control table 112 includes a subfield number column 601, an SF pixel data transfer period (address period) column 602, and a sustain discharge period column 603, so that a subfield number, an SF pixel data transfer period (address period), and a sustain discharge period are indicated and are associated with each other.

The 10 SF control table 112 differs from the 8 SF control table 111 in two points: one is that the total number of subfields is 10; and the other is that the sustain discharge periods in the respective subfields are different.

For example, in the 10 SF control table 112, the sustain discharge period associated with the subfield number 1 (SF1) is 0.16 msec.

Note that one TV field period is commonly 16.7 msec long regardless of whether the one TV field includes 8 subfields or 10 subfields, and the address period in each subfield is fixed to 0.78 msec (0.78 msec is definitely required for address setting). Accordingly, when one TV field is divided into 10 subfields, the respective sustain discharge periods inevitably become shorter than those in the case of 8 subfields. Although there is no choice but to shorten the sustain discharge periods in the subfields when one TV field is divided into 10 subfields, a finer image representation is realized by dividing into the 10 subfields.

<Operations>

Figure 7:
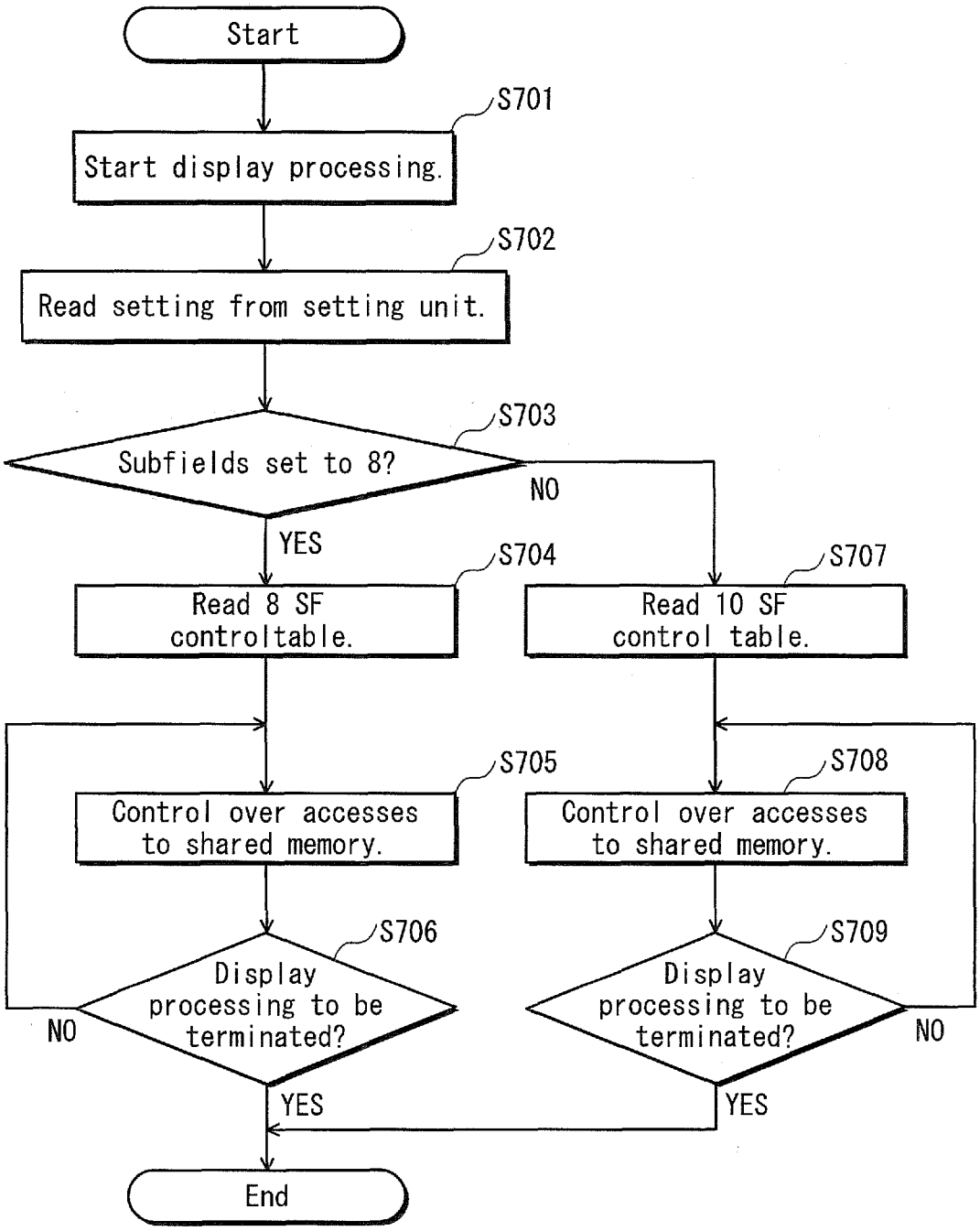
FIG. 7 is a flowchart showing operations of controlling accesses to the shared memory based on the total number of subfields according to Embodiment 2.

A description is given of operations of the integrated circuit 200 according to the Embodiment 2, with reference to a flowchart of FIG. 7.

The plasma display system starts display processing (step S701).

The control unit 204 reads from the setting unit 201 the total number of subfields which has been set (step S702).

The control unit 204 then determines whether or not the total number of subfields read from the setting unit 201 is 8 (step S703).

When the total number of subfields set is 8 (YES in the step S703), the control unit 204 reads the 8 SF control table 111 from the control table storage unit 210 (step S704).

Subsequently, according to the read 8 SF control table 111, the control unit 204 repeats the control shown in the flowchart of FIG. 3 (step S705).

The control unit 204 determines whether or not the display processing is to be terminated (step S706). This determination depends on whether or not a user input instructing termination of the display processing has been received by means of a remote control (not shown).

When the display processing is not to be terminated (NO in the step S706), the processing returns to the step S705. On the other hand, when the display processing is to be terminated (YES in the step S706), the control unit 204 terminates the access control, and the plasma display system terminates the display processing.

When the total number of subfields set is not 8 (NO in the step S703), the control unit 204 reads the 10 SF control table 112 from the control table storage unit 210 (step S707).

Subsequently, according to the read 10 SF control table 112, the control unit 204 sets N in the step S301 to be 10 and repeats the control shown in the flowchart of FIG. 3 (step S708).

The control unit 204 determines whether or not the display processing is to be terminated (step S709). This determination depends on whether or not a user input instructing termination of the display processing has been received by means of the remote control (not shown).

When the display processing is not to be terminated (NO in the step S709), the processing returns to the step S708. On the other hand, when the display processing is to be terminated (YES in the step S709), the control unit 204 terminates the access control, and the plasma display system terminates the display processing.

By the above processes, the control unit 204 is able to control accesses from the moving picture decoder 101 and the SF reading unit 103 to the shared memory 140 while changing the access periods according to the total number of subfields set in the setting unit 201.

Regarding the access control by the control unit 204 over accesses from the moving picture decoder 101 and the SF reading unit 103 to the shared memory 140 in the case where the total number of subfields is 10, a detailed description thereof is omitted here, since the differences are only that N in the step S301 of the flowchart of FIG. 3 is set to be 10, not 8, and that the 10 SF control table 112 is referred to for the purpose of the control.

<Embodiment 3>

The Embodiment 1 describes the structures in which the SF reading unit 103 sequentially reads each piece of SF pixel data of each frame from the shared memory 140. On the other hand, the Embodiment 3 describes structures in which reading of the SF pixel data from the shared memory can be restricted.

Note that the Embodiment 3 only describes structures that are different from those in Embodiment 1, and a description of common structures is omitted here.

<Structures>

Figure 8:
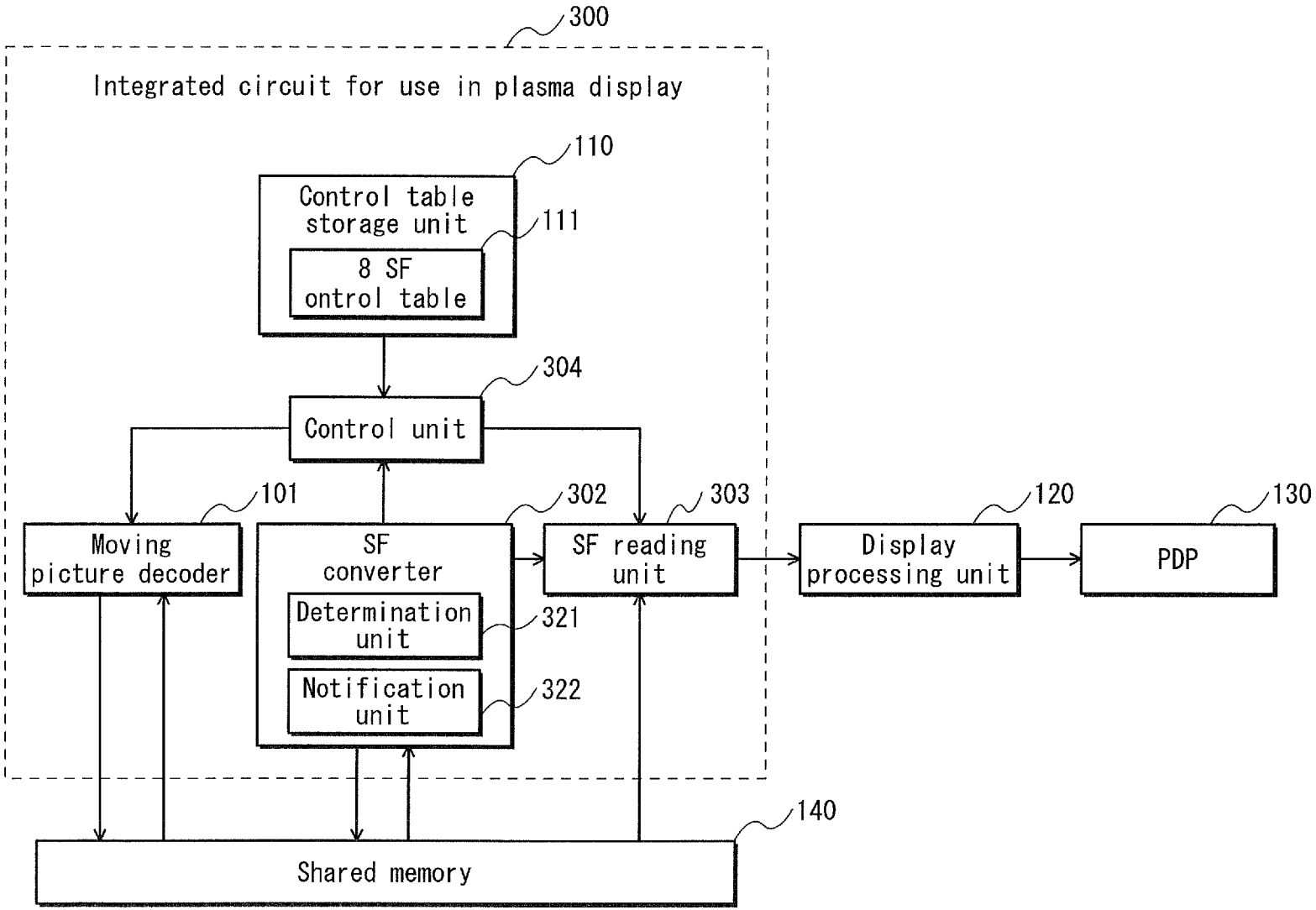
FIG. 8 is a functional block diagram showing another functional structure of the plasma display system according to Embodiment 3.

FIG. 8 is a functional block diagram showing a functional structure of the plasma display system including an integrated circuit 300 for use in a plasma display (abbreviated below as the "integrated circuit 300") according to the Embodiment 3.

A SF converter 302 has the following functions in addition to the functions of the SF converter 102 described in the Embodiment 1. The SF converter 302 includes a determination unit 321 and a notification unit 322.

The determination unit 321 has a function of determining whether or not pieces of SF pixel data in one frame (i.e. one TV field) have a predetermined pattern, the pieces of SF pixel data being obtained by conversion of the SF converter 302. The details of an example of the pattern data is described later.

When the determination unit 321 determines that the pieces of SF pixel data obtained through the conversion has the predetermined pattern, the notification unit 322 notifies the predetermined pattern to an SF reading unit 303. At the same time, the notification unit 322 also notifies which subfield of which frame corresponds to the predetermined pattern. In other words, the notification unit 322 notifies a frame number and a subfield number.

Furthermore, the notification unit 322 has a function of notifying a control unit 304 of detection of the predetermined pattern, as well as the frame number and the subfield number corresponding to the detected predetermined pattern.

In addition to the functions held by the SF reading unit 103, the SF reading unit 303 has a function of, upon reception of the subfield number and the pattern data from the notification unit 322, notifying the display processing unit 120 of pieces of SF pixel data conforming to the pattern data without reading from the shared memory 140 the pieces of SF pixel data specified by the subfield number. For example, assume that the pattern data indicates that all pixels are 1. In this case, the SF reading unit 303 notifies the display processing unit 120 of the fact that the pieces of pixel data for the respective pixels are 1 (specifically, pieces of SF pixel data each indicating 1 for the pixels included in the subfield specified by the subfield number).

In addition to the function held by the control unit 104, the control unit 304 has a function of, upon notification of detection of the predetermined pattern from the notification unit 322, permitting the moving picture decoder 101 to access the shared memory 140 at timing corresponding to the frame number and the subfield number, that is to say, the timing at which the SF reading unit 303 was originally supposed to read pieces of SF pixel data.

<Data>

Now, a description is given of the pattern data that is held by the determination unit 321 of the SF converter 302 and that is used for determination about whether or not the pieces of SF pixel data have a corresponding pattern.

FIG. 9 shows an example of the structure of the pattern data.

Pattern data 900 includes a pattern number column 901 and a pattern data content column 902, so that a pattern number and a pattern data content are indicated and are associated with each other.

The pattern number column 901 indicates identifiers used by the SF converter 321 to distinguish and manage pieces of pattern data.

The pattern data content column indicates predetermined patterns of pieces of SF pixel data, each pattern of pieces of SF pixel data corresponding to a piece of subfield data, by specifying each pixel value (0 or 1) in the piece of subfield data. Note that in FIG. 9 only a part of the pattern data is shown for the sake of space in the drawing. Furthermore, as in the case of a pattern number 001, when the pattern data content indicates that all the pixels are 1, the pieces of data for the respective pixels do not need to be stored, and only a piece of information indicating that all the pixels are 1 may be stored. Moreover, as in the case of a pattern number 003, the associated pattern data content may be a piece of information indicating that a given pattern is repeated.

<Operations>

Figure 10:
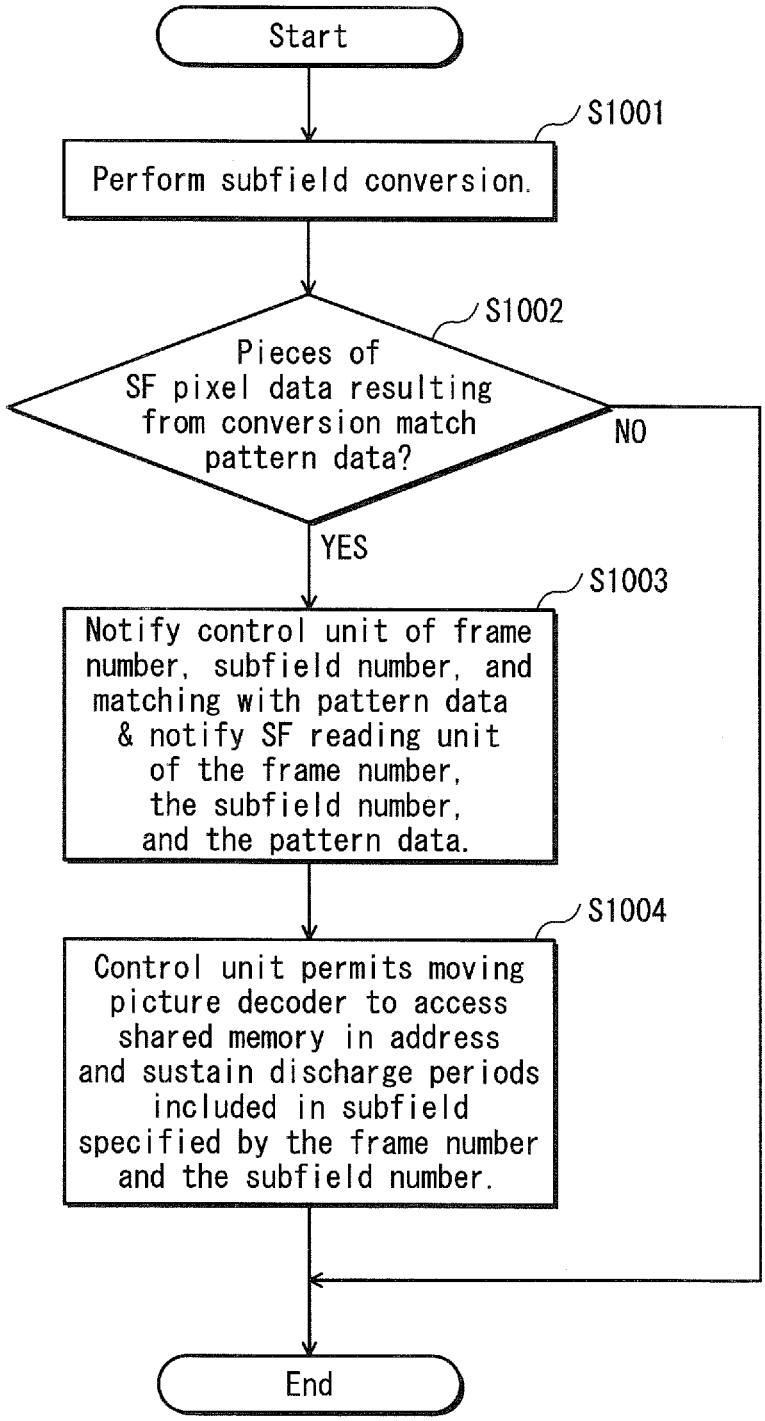
FIG. 10 is a flowchart showing operations of an integrated circuit for use in a plasma display according to Embodiment 3.
Figure 11:
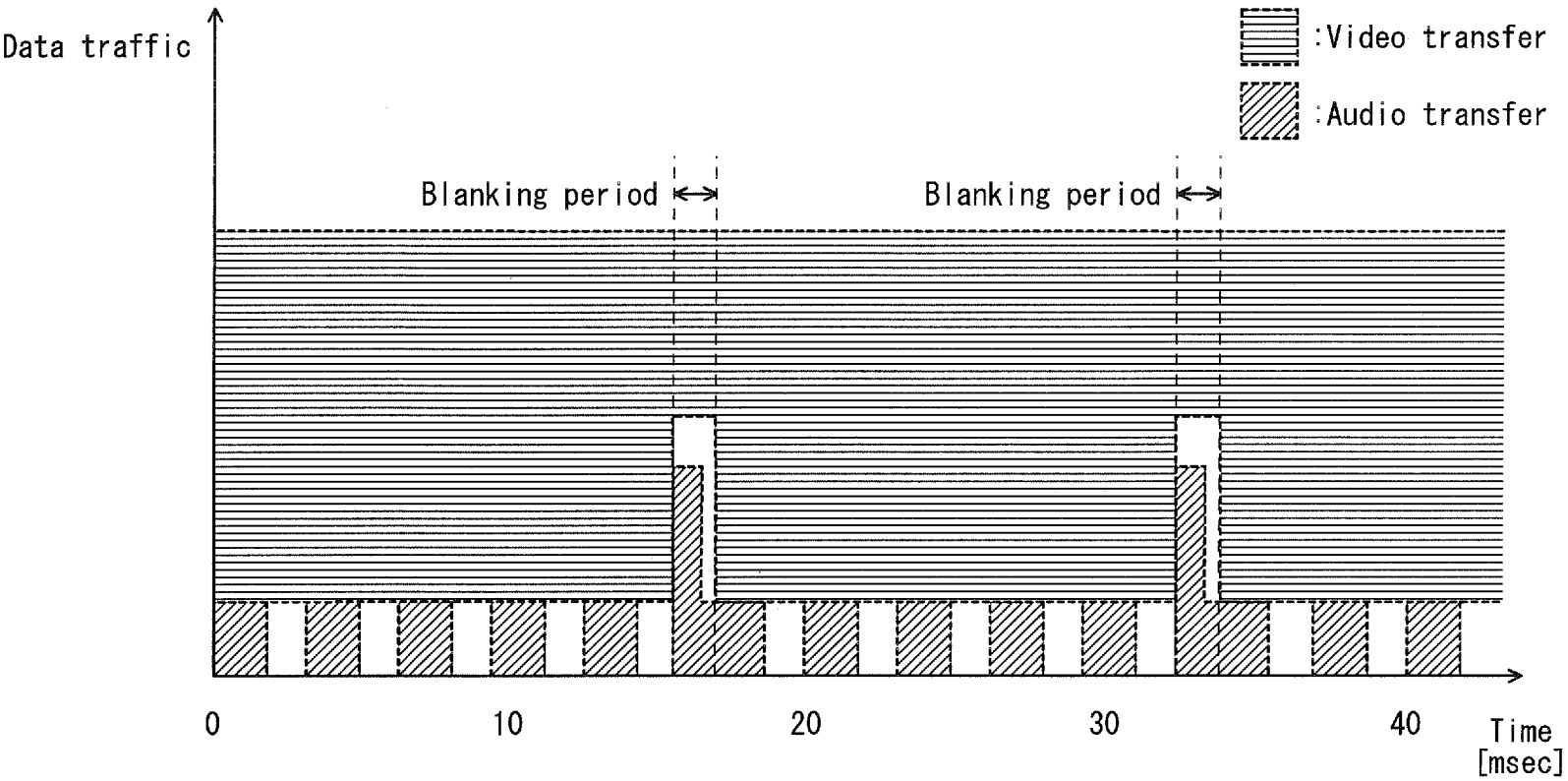
FIG. 11 is a graph showing temporal changes in data traffic when video data and audio data readings are under control according to conventional technologies.

A description is given of operations of the integrated circuit 300 according to the Embodiment 3, with reference to a flowchart of FIG. 10. The series of procedure is executed each time the SF converter 302 completes conversion for one subfield.

The SF converter 302 converts the decoded data, which has been decoded by the moving picture decoder 101 and stored in the shared memory 140, into pieces of SF pixel data (step S1001).

The determination unit 321 determines whether of not the pieces of SF pixel data resulting from conversion match any one of the stored pattern data contents. This determination depends on whether or not pieces of pixel data specified by any one of the pattern data contents completely match the pieces of SF pixel data.

When the determination unit 321 determines in the negative (NO in the step S1002), the control procedure is terminated.

When the determination unit 321 determines in the positive (YES in the step S1002), the notification unit 322 notifies the SF reading unit 303 of the matching pattern data, the corresponding subfield number, and a frame number including the subfield. As a result, the SF reading unit 303 acquires the pieces of SF pixel data of the subfield number included in the frame number and transmits the acquired pieces of SF pixel data to the display processing unit 120, without accessing the shared memory 140. The notification unit 322 also notifies the control unit 304 of the frame number, the subfield number, and the information that the pattern data has matched (step S1003).

Upon receiving the notification, the control unit 304 permits the moving picture decoder 101 to access the shared memory 140 only in the address and the sustain discharge periods included in the subfield specified by the subfield number of the frame number as notified (step S1004), and ends the processing.

With the above structures, when the pieces of SF pixel data have a simple predetermined pattern, reading of the pieces of SF pixel data is prohibited. Consequently, accesses from the SF reading unit 303 to the shared memory 140 is restricted, and furthermore, the moving picture decoder 101 is able to handle an increased amount of traffic in accessing the shared memory 140.

<Supplementary Description 1>

Although the preferred Embodiments of the present invention have been described above, the present invention is not of course limited to the above Embodiments. The following describes other modification examples of the present invention than the above Embodiments.

(1) In the above Embodiments the control unit 104 prohibits the moving picture decoder 101 from accessing the shared memory 140 while the SF reading unit 103 is reading the SF pixel data from the shared memory 140.

However, the above control of prohibiting the moving picture decoder 101 from accessing the shared memory 101 is not limited to prohibition, and can be any control that helps restricting the peak data traffic among the moving picture decoder 101, the SF reading unit 103, and the shared memory 101.

For example, assume that the moving picture decoder 101, the SF reading unit 103, and the shared memory 140 are connected to a bus line comprising a plurality of signal lines, and that a memory access bandwidth used for accessing the bus line is set for each of the moving picture decoder 101, the SF reading unit 103, and the shared memory 140.

In this case, while the SF reading unit 103 is reading the SF pixel data, the control unit 104 does not minimize the memory access bandwidth set for the moving picture decoder 101 to zero (i.e. prohibition), but reduces the memory access bandwidth (e.g. from 64 Mbit/sec to 16 Mbit/sec).

The above structures can be employed for the control unit 104 to restrict accesses from the moving picture decoder 101 to the shared memory 140. The above structures are effective in such a situation where decoding of a moving picture might not otherwise be finished in the sustain discharge periods.

(2) Although in the Embodiment 1 the access control is performed with use of the control table shown in FIG. 3, the control may be switched using a program specifying the timings as shown in the control table. By doing so, a memory area for storing the control table can be spared.

(3) Although in the above Embodiments the moving picture decoder 101 is described as a decoder conforming to the MPEG4AVC standards, the moving picture decoder 101 is not limited to the one conforming to the MPEG4AVC standards. The moving picture decoder 101 may be operated conforming to the MPEG2 standards or the MPEG4SP standards, or even may be a decoder that decodes stream data compressed according other standards.

(4) The structures described in the Embodiment 3 is described as additional structures to those described in the Embodiment 1. However, the structures described in the Embodiment 3 may, of course, be incorporated into the integrated circuit 200 as described in the Embodiment 2.

(5) Although in the above Embodiments the integrated circuit 100 is described as an integrated circuit, the integrated circuit 100 may be, for example, a device or a dedicated circuit with the equivalent functions that is capable of receiving encoded data and outputting subfield data.

(6) Although the Embodiment 2 describes the example where the total number of subfields is either 8 or 10, the total number of subfields is not limited to this example, and may be any other numbers depending on a total number of gradation expressions.

That is to say, the control table storage unit 210 may also store control tables corresponding to different numbers of subfields (other than 8 and 10), and the control unit 204 may read one of the stored control tables corresponding the total number of subfields that has been set in the setting unit 201 to execute the access control according to the control table.

(7) The above Embodiments do not particularly describe timings at which the SF converter 102 (302) is to access the shared memory 140. This is because the peak data traffic can be restricted merely by controlling accesses from the moving picture decoder 101 and the SF reading unit 103 (303) to the shared memory 140. Actually, the SF converter 102 (302) reads a decoded image and stores the pieces of SF pixel data by properly accessing the shared memory 140 in time for when the SF reading unit 103 (303) starts to read pieces of SF pixel data of a next subfield. The SF converter 102 (302) may access the shared memory 140 between accesses from the moving picture decoder 101 and the SF reading unit 103 (303) to the shared memory 140. Alternatively, respective memory bandwidths may be set for the moving picture decoder 101, the SF converter 102 (302), and the SF reading unit 103 (303) to access the shared memory 140, so that the accesses are made within the respective memory bandwidths.

(8) In the Embodiment 3, the control unit 304 performs control, for one subfield, of permitting the moving picture decoder 101 to access the shared memory depending on whether or not the pixels in the subfield match any one of the data patterns.

However, the above control is not limited to be performed on a subfield-by-subfield basis. For example, the access permission to the shared memory may be given to the moving picture decoder 101 in a display period of one TV field, depending on whether or not pieces of SF pixel data for all the subfields included in the one TV field match the pattern data. Conversely, the access permission to the shared memory may also be given to the moving picture decoder 101, either depending on whether or not one of a plurality of lines, which are the units smaller than the units of subfields and constituting one subfield, matches the pattern data, or depending on whether pixels included in a macro-block in a subfield or in an area of a predetermined range match the pattern data.

Note that, when the control is performed on a line-by-line basis, or on a block-by-block basis, the notification unit 322 is configured to notify information regarding the line or the block (e.g. a coordinate value indicating a line number or a range).

(9) Although in the above Embodiments the SF reading unit 103 repeats to read the pixel data from a piece of pixel data for SF8 to a piece of pixel data for SF1 in order of decreasing number, the reading is not limited to be performed in this order. For example, the SF reading unit 103 may reads the pixel data in reverse order, that is to say, from the piece of pixel data for SF1 to the piece of pixel data for SF8.

(10) Although not particularly described in the above Embodiments, the sustain discharge periods of the subfields are calculated as follows. The time length of one TV field is fixed at 16.7 msec, and one address period in any subfield must also be fixed at 0.78 msec. Accordingly, a total time that can be used for the sustain discharge periods in one TV field is obtained by deducting 0.78×the total number of subfields [msec] from 16.7 msec. Furthermore, the sustain periods must be set in a manner such that the time period of each subfield is multiple of the time period of a subfield having the shortest time period (e.g. the sustain discharge period in SF2 is twice that in SF1, and the sustain discharge period in SF3 is twice that in SF2), and that the sustain discharge periods total no more than the time obtained as above. To be more specific, the sustain discharge periods can be calculated by geometric series with a factor of 2.

Note that the time period of one TV field and the time period of one address period are not limited to the above. The time period of one TV field can vary, for example, according to an instruction from a broadcast station, and the time period of one address period can vary according to performance for address setting processing of the integrated circuit for use in a plasma display. In this case, the total time period of the sustain discharge periods can be calculated with use of the above method, from the time period assigned to one TV field, the time period assigned to one address period, and the total number of subfields. Specifically, supposing that the assigned time period of one TV field is X, the time period of one address period is Y, and the total number of subfields is Z, the time period that can be used for the sustain discharge periods is $X-Y\times Z$. Then, supposing that the sustain discharge period in SF1 is t, for example, the time period of the sustain discharge period in each of other subfields can be defined by obtaining t that satisfies $t+2t+2t^2+\ldots+2t^{Z-1}=X-Y\times Z$.

(11) Although in the above Embodiments each of the integrated circuits 100, 200, 300 is described as a so-called LSI, the LSI is also called an IC (Integrated Circuit), a system LSI, an SLSI (Super Large Scale Integration), a VLSI (Very Large Scale Integration), or a ULSI (Ultra Large Scale Integration) depending on the degree of integration.

Furthermore, if integration technology is developed that replaces LSIs due to the progress in semiconductor technology and other derivative technologies, it is naturally possible to integrate functional blocks of the integrated circuit for use in a plasma display using this technology. For example, the application of biotechnology is a possibility.

(12) The plasma display system according to the above Embodiments includes the integrated circuit for use in a plasma display, and the integrated circuit for use in a plasma display includes the moving picture decoder, the SF converter, and the SF reading unit. However, it is not necessary to form the moving picture decoder, the SF converter, and the SF reading unit as the single integrated circuit, as long as the moving picture decoder and the SF reading unit are capable of accessing the common shared memory under control of the control unit.

(13) It is also possible to have the following control program stored in a storage medium, or circulated and distributed through various communication channels: the control program comprising program codes for causing the processors in PDPs or in playback devices for a PDP, or the circuits which are connected thereto to execute the operations of memory accesses and the processing of restricting the accesses (see FIGS. 3, 7, 10, etc.) as described in the above Embodiments. Such a storage medium includes an IC card, a hard disk, an optical disk, a flexible disk, and a ROM. The circulated and distributed control program becomes available as it is contained in a memory and the like which can be read by a processor. The control program is then executed by the processor, so that the various functions as described in the Embodiments will be realized.

<Supplementary Description 2>

A description is given below of preferred embodiments of the integrated circuit for use in a plasma display according to the present invention, and advantageous effects of the embodiments.

One aspect of the present invention provides an integrated circuit for use in a plasma display panel, comprising: a decoder that reads encoded moving picture data from a shared memory, decodes the encoded moving picture data to obtain decoded data, and stores the decoded data in the shared memory, wherein the shared memory is shared by the decoder, a converter, a reading unit, and an access control unit; the converter that reads the decoded data from the shared memory, converts the decoded data into subfield data, and stores the subfield data in the shared memory; the reading unit that reads the subfield data from the shared memory; and the access control unit that restricts an access from the decoder to the shared memory while the reading unit is reading the subfield data from the shared memory.

Another aspect of the present invention provides a method for controlling an access to a shared memory in an integrated circuit for use in a plasma display, wherein the shared memory is shared by a moving picture decoder, a converter, a reading unit, the plasma display including: the moving picture decoder that decodes encoded moving picture data and stores decoded data in the shared memory; the converter that converts the decoded data into subfield data and stores the subfield data in the shared memory; and the reading unit that reads the subfield data from the shared memory, the method comprising the steps of: a decoding step, performed by the moving picture decoder, of reading the encoded moving picture data from the shared memory, converting the encoded moving picture data into decoded data, and storing the decoded data in the shared memory; a conversion step, performed by the converter, of reading the decoded data from the shared memory, converting the decoded data into the subfield data, and storing the subfield data in the shared memory; a reading step, performed by the reading unit, of reading the subfield data; and a restriction step of restricting an access to the shared memory in the decoding step while the subfield data is being read in the reading step.

Yet another aspect of the present invention provides a plasma display system comprising: a decoder that reads encoded moving picture data from a shared memory, decodes the encoded moving picture data to obtain decoded data, and stores the decoded data in the shared memory, wherein the shared memory is shared by the decoder, a converter, a reading unit, and an access control unit; the converter that reads the decoded data from the shared memory, converts the decoded data into subfield data, and stores the subfield data in the shared memory; the reading unit that reads the subfield data from the shared memory; the access control unit that restricts an access from the decoder to the shared memory while the reading unit is reading the subfield data from the shared memory; and a display processing unit that executes display processing in accordance with the subfield data read by the reading unit.

Here, the decoded data that the moving picture decoder is to obtain through decoding corresponds to a subsequent frame to a frame including the decoded data that the converter is converting. Furthermore, the subfield data that the converter is to obtain through conversion corresponds to a subsequent subfield to a subfield associated with the subfield data that the reading unit is reading.

Consequently, the peak data traffic is restricted in accesses from the moving picture decoder and the reading unit to the shared memory.

Since the reading unit does not need to read the subfield data in a sustain discharge period, the reading unit does not access the shared memory in the period. In the sustain discharge period, the moving picture decoder is obliged to access the shared memory. As a result, the moving picture decoder and the reading unit are prevented from almost simultaneously accessing the shared memory, whereby the peak data traffic between the shared memory and the integrated circuit for use in a plasma display is restricted. Consequently, heat generation accompanying data transfer is also restricted, and reliability of the integrated circuit for use in a plasma display is improved.

Furthermore, in the above integrated circuit for use in a plasma display, the integrated circuit may further comprise: a storage unit storing at least one control table that defines, according to a total number of subfields included in one TV field of the moving picture data, timings at which the reading unit is to read the subfield data, wherein the access control unit restricts the access from the decoder to the shared memory in accordance with the timings defined by the control table.

With the control table, the control unit is able to perform precise control over accesses from the reading unit and the moving picture decoder.

Furthermore, in the above integrated circuit for use in a plasma display, the integrated circuit may further comprise: a setting unit that sets the total number of subfields to be included in one TV field of the moving picture data, wherein the at least one control table comprises two or more control tables that define the timings individually for a plurality of possible total numbers of subfields, and the access control unit restricts the access from the decoder to the shared memory by retrieving one of the two or more control tables in accordance with the total number of subfields that the setting unit has set.

With the above structure, the integrated circuit for use in a plasma display is able to cope with a situation where the plasma display varies the total number of subfields depending on the expression level, thereby performing the control over the accesses to the shared memory as appropriate for the total number of subfields.

Furthermore, in the above integrated circuit for use in a plasma display, the converter may include a determination unit that determines whether or not the subfield data has a predetermined data pattern, and a notification unit that notifies, when the determination unit determines that the subfield data has the data pattern, the reading unit of the data pattern. Furthermore, when notified by the notification unit of the data pattern, the reading unit may specify cells to be illuminated according to the data pattern instead of accessing the shared memory.

With the above structure, when pixels have the predetermined pattern in the subfield data with respect to one subfield, the cells to be illuminated are specified without reading the substantial subfield data. That is to say, a need for the reading unit to access the shared memory is omitted, which facilitates the moving picture decoder to access the shared memory for decoding. As a result, processing efficiency is improved.

Furthermore, in the above integrated circuit for use in a plasma display, the access control unit may restrict the access to the shared memory by prohibiting the decoder from accessing the shared memory.

With the above structure, the moving picture decoder is prohibited from accessing the shared memory while the reading unit is accessing the shared memory. As a result, the reading unit and the moving picture decoder are prevented from accessing the shared memory very simultaneously, whereby the peak data traffic between the shared memory and the integrated circuit for use in a plasma display is restricted.

Furthermore, in the above integrated circuit for use in a plasma display, the access control unit may restrict the access to the shared memory by setting less a maximum memory bandwidth that the decoder uses to access the shared memory while the reading unit is reading the subfield data than a maximum memory band width that the decoder uses to access the shared memory while the reading unit is not reading the subfield data.

With the above structure, the moving picture decoder is still allowed to access the shared memory even while the reading unit is accessing the shared memory. As a result, compared with for example the case where the moving picture decoder is prohibited from accessing the shared memory while the reading unit is accessing the shared memory, the moving picture decoder is able to handle a larger amount of processing, thereby avoiding a situation where decoding processing by the moving picture decoder does not catch up with display processing.

An PDP display system according to the present invention is useful in, for example, a PDP and a playback device as a system capable of restricting peak data traffic in memory accesses to a shared memory.

REFERENCE SIGNS LIST

100, 200, 300 integrated circuit for use in plasma display
101 moving picture decoder
102, 302 SF converter
103, 303 SF reading unit
104, 204, 304 control unit
110, 210 control table storage unit
120 display processing unit
130 PDP
140 shared memory
201 setting unit
321 determination unit
322 notification unit

The invention claimed is:

1. An integrated circuit for use in a plasma display panel, comprising:

a decoder that reads encoded moving picture data from a shared memory, decodes the encoded moving picture data to obtain decoded data, and stores the decoded data directly in the shared memory using a direct connection to the shared memory, wherein the shared memory is shared by the decoder, a converter, a reader, and an access controller;

the converter reads the decoded data from the shared memory, converts the decoded data into subfield data, and stores the subfield data directly in the shared memory using a direct connection to the shared memory;

the reader reads the subfield data directly from the shared memory using a direct connection to the shared memory; and the access controller:

(i) restricts access to the shared memory from the decoder during a first period in which a cell among plasma display panel cells is specified as a cell to be illuminated according to the subfield data; and (ii) restricts access to the shared memory from the reader during a second period in which the specified cell is illuminated.

2. The integrated circuit of claim 1, further comprising:

storage that stores at least one control table that defines the first period and the second period according to a total number of subfields included in one TV field of the moving picture data, wherein the access controller restricts the access to the shared memory from the decoder and from the reader in accordance with the first period and the second period defined by the control table.

3. The integrated circuit of claim 2, further comprising:

a setter that sets the total number of subfields to be included in one TV field of the moving picture data, wherein the at least one control table comprises two or more control tables that define the first period and the second period individually for a plurality of possible total numbers of subfields, and the access controller restricts the access to the shared memory from the decoder and from the reader by retrieving one of the two or more control tables in accordance with the total number of subfields that the setter has set.

4. The integrated circuit of claim 3, wherein the converter includes a determiner that determines whether or not the subfield data has a predetermined data pattern, and a notifier that notifies, when the determiner determines that the subfield data has the data pattern, the reader of the data pattern, and when notified by the notifier of the data pattern, the reader specifies, from among the plasma display panel cells, a cell to be illuminated according to the data pattern instead of accessing the shared memory.

5. The integrated circuit of claim 1, wherein the access controller restricts the access to the shared memory from the decoder by prohibiting the decoder from accessing the shared memory.

6. The integrated circuit of claim 1, wherein the access controller restricts the access to the shared memory from the decoder by setting a maximum memory bandwidth that the decoder uses to access the shared memory during the first period to less than a maximum memory bandwidth that the decoder uses to access the shared memory during a period other than the first period.

7. A method for controlling an access to a shared memory in an integrated circuit for use in a plasma display, wherein the shared memory is shared by a moving picture decoder, a converter, and a reader included in the plasma display, the method comprising the steps of:

a decoding step, performed by the moving picture decoder, of reading the encoded moving picture data from the shared memory, converting the encoded moving picture data into decoded data, and storing the decoded data directly in the shared memory using a direct connection to the shared memory;

a conversion step, performed by the converter, of reading the decoded data from the shared memory, converting the decoded data into the subfield data, and storing the subfield data directly in the shared memory using a direct connection to the shared memory;

a reading step, performed by the reader, of reading the subfield data directly from the shared memory using a direct connection to the shared memory; and a restriction step of:

(i) restricting access to the shared memory from the moving picture decoder during a first period in which a cell among plasma display panel cells is specified as a cell to be illuminated according to the subfield data; and (ii) restricting access to the shared memory from the reader during a second period in which the specified cell is illuminated.

8. A plasma display system comprising:

a decoder that reads encoded moving picture data from a shared memory, decodes the encoded moving picture data to obtain decoded data, and stores the decoded data directly in the shared memory using a direct connection to the shared memory, wherein the shared memory is shared by the decoder, a converter, a reader, and an access controller;

the converter reads the decoded data from the shared memory, converts the decoded data into subfield data, and stores the subfield data directly in the shared memory using a direct connection to the shared memory;

the reader reads the subfield data directly from the shared memory using a direct connection to the shared memory; and the access controller:

(i) restricts access to the shared memory from the decoder during a first period in which a cell among plasma display panel cells is specified as a cell to be illuminated according to the subfield data; and (ii) restricts access to the shared memory from the reader during a second period in which the specified cell is illuminated.

* * * * *